United States Patent [19]

Jasch

[11] 3,967,699

[45] July 6, 1976

[54] HOISTING APPARATUS, PARTICULARLY FOR A COOLING TOWER

[75] Inventor: Erich Jasch, Leeheim, Germany

[73] Assignee: Fried. Krupp Gesellschaft mit beschrankter Haftung, Essen, Germany

[22] Filed: Jan. 6, 1975

[21] Appl. No.: 538,523

[30] Foreign Application Priority Data

Jan. 4, 1974 Germany ..... 2400313

[52] U.S. Cl. ..... 187/2; 52/83; 52/223 R; 52/245; 52/749; 182/38; 182/142; 187/1 R; 187/7; 187/95

[51] Int. Cl.[2] ..... B66B 9/16; E04G 3/16

[58] Field of Search ..... 187/1 R, 2, 6, 7, 8, 187/17, 27, 95; 182/36, 37, 38, 142; 52/30, 245

[56] References Cited

UNITED STATES PATENTS

| | | | |
|---|---|---|---|
| 444,670 | 1/1891 | Moir | 187/8 |
| 516,893 | 3/1894 | Leyson | 187/7 |
| 523,978 | 8/1894 | Dunning | 187/7 X |
| 665,707 | 1/1901 | Tromanhauser | 182/38 |
| 868,117 | 10/1907 | Olney | 187/7 |
| 1,086,329 | 2/1914 | Liess | 187/7 X |
| 2,405,259 | 8/1946 | Lamb | 182/38 |
| 3,095,060 | 6/1963 | Reinhardt | 182/142 X |
| 3,630,315 | 12/1971 | Meyer | 182/142 |
| 3,671,712 | 6/1972 | Fisher | 182/142 X |
| 3,837,429 | 9/1974 | Harris | 182/37 |

*Primary Examiner*—Richard A. Schacher
*Assistant Examiner*—James L. Rowland
*Attorney, Agent, or Firm*—Spencer & Kaye

[57] ABSTRACT

A hoisting apparatus mounted on a building structure has parallel-extending upper and lower tracks attached to the building structure and supporting a respective upper and lower traveling block movable thereon by a propelling device, a hoisting cage supported by and between the traveling blocks and a hoisting device for raising or lowering the cage between the traveling blocks.

4 Claims, 8 Drawing Figures

FIG. 4
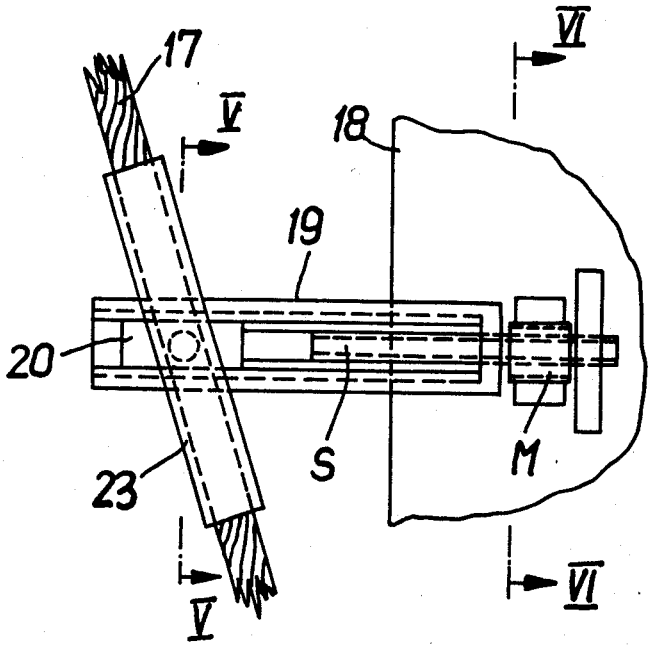
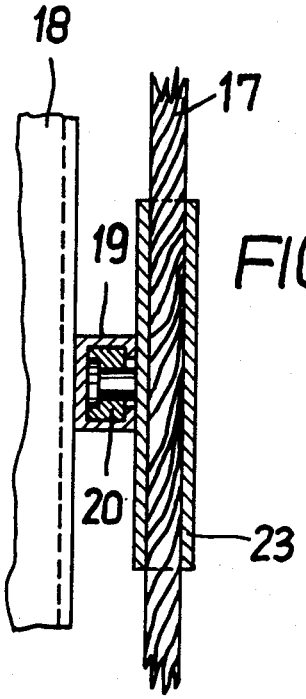
FIG.5
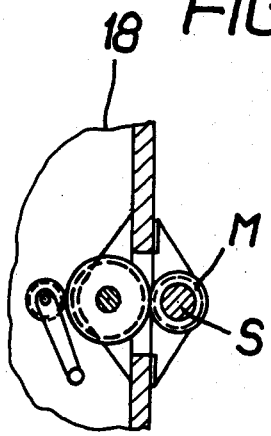
FIG.6

HOISTING APPARATUS, PARTICULARLY FOR A COOLING TOWER

BACKGROUND OF THE INVENTION

This invention relates to an auxiliary hoisting apparatus, particularly for a building structure, such as a cooling tower having a casing which is not self-supporting and which is secured to a cable net framing supported by a mast. When the construction of a cooling tower of the above-outlined type has reached the stage where the mast is in place and at least the principal portion of the cable net is tensioned between a head ring mounted on the mast and the foundation members, the completion of the cable net framing and the attachment of the casing require a very substantial amount of work. This is particularly the case when the casing is formed of a great number of plates which are adjoiningly attached to the cable net framing.

SUMMARY OF THE INVENTION

It is an object of the invention to provide a hoisting apparatus, particularly for facilitating the above-outlined assembling operation.

This object and others to become apparent as the specification progresses, are accomplished by the invention, according to which, briefly stated, there is provided a hoisting apparatus which is mounted on a building structure and which has parallel-extending upper and lower tracks attached to the building structure and supporting a respective upper and lower traveling block movable thereon by a propelling device, a hoisting cage supported by and between the traveling blocks and a hoisting device for raising or lowering the cage between the traveling blocks.

With the aid of the apparatus according to the invention, the assembly of cooling towers of the above-outlined type can be significantly expedited at a modest expense. In particular, the invention permits the simultaneous performance of work in a plurality of juxtapositioned or vertically adjoining sections of the walls of the cooling tower in the work area. Further, the hoisting apparatus according to the invention may be used, after completion of the cooling tower, for monitoring the condition of the cable net framing and the cooling tower casing and/or performing maintenance work thereon.

BRIEF DESCRIPTION OF THE DRAWINGS

FIG. 4 is a side elevational view of a detail of FIG. 2 at an enlarged scale.

FIG. 5 is a sectional view taken along line V—V of FIG. 4.

FIG. 6 is a sectional view taken along line VI—VI of FIG. 4.

DESCRIPTION OF THE PREFERRED EMBODIMENTS

Figure 1:
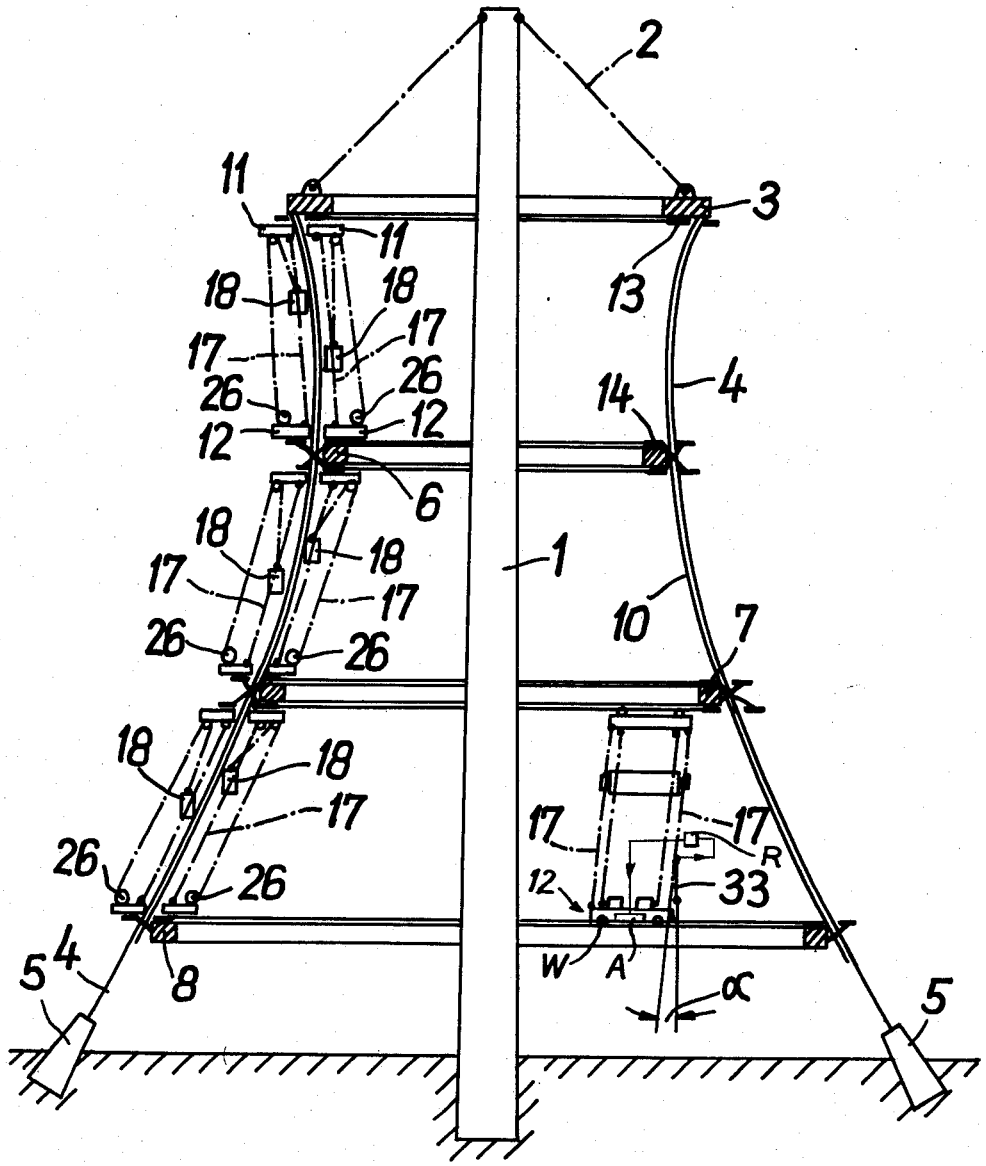
FIG. 1 is a schematic axial sectional view of a cooling tower incorporating the invention.

Turning now to FIG. 1, the building structure with which the apparatus according to the invention is associated is a cooling tower which comprises a mast 1 from which there is suspended, by means of cables 2, a head ring 3. From the head ring 3 there extend cables 4 to foundation members 5 in such a manner that their central lines lie in the meridian planes of the cooling tower and form outwardly concave curves. At various heights, the cables 4 are radially supported by rigid spacer rings 6, 7 and 8 which are attached to the mast 1, for example, by means of spokes. Further, the cables 4 are interconnected by means of cable hoops 9 (FIG. 2) to form a cable net framing which is prestressed. At the inner side of the cable net framing 4, 9 there is secured a non-self-supporting casing 10 which may be constituted by a shell or skin made of a resistant material. It is further feasible to form the casing 10 of plates which are secured to the cable net framing 4, 9 in an adjoining or in a roof-like, overlapping relationship.

In each of the three tower sections bounded by the rings 3, 6, 7 and 8, preferably at both the inner and the outer side of the cooling tower wall, there is provided an auxiliary hoisting apparatus structured according to the invention and now to be described.

Figure 2:
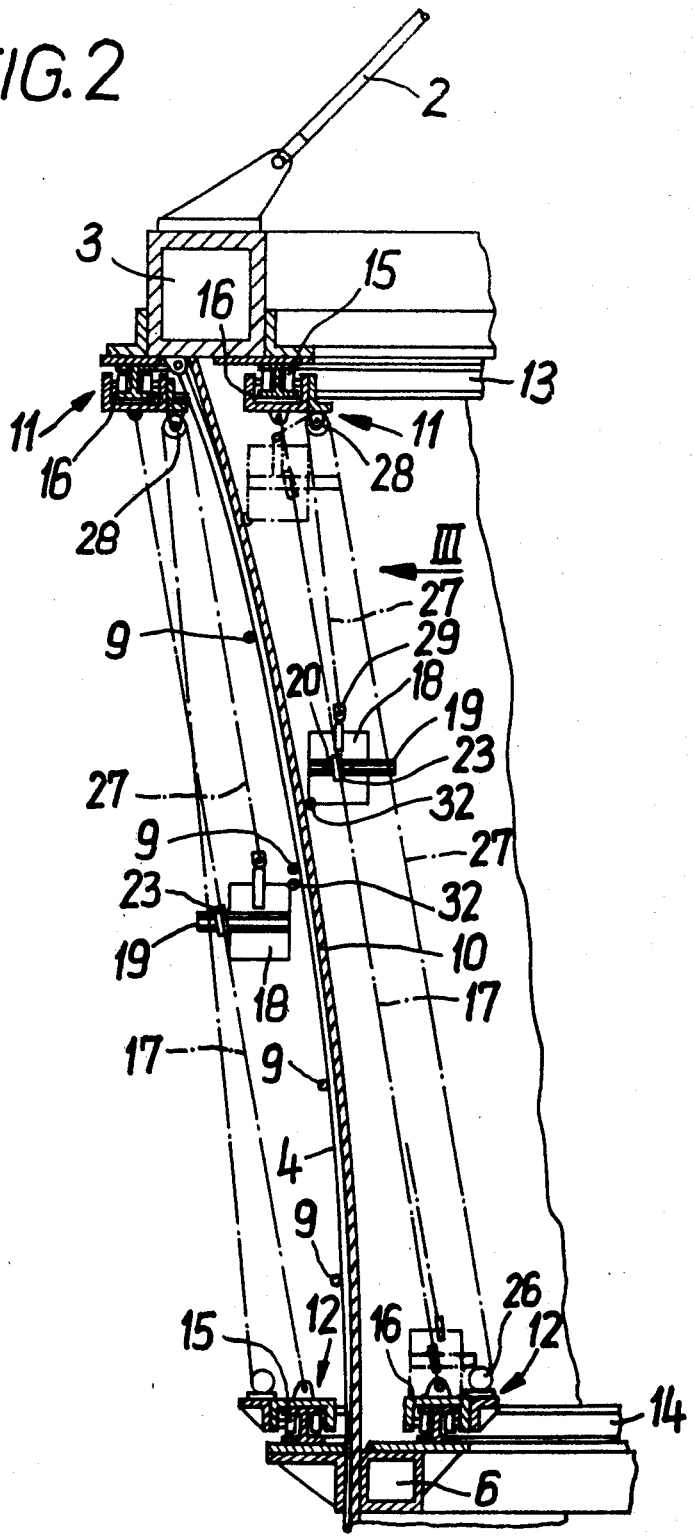
FIG. 2 is an axial sectional view of a detail of FIG. 1 at an enlarged scale.

In FIG. 2, there is illustrated an inner and an outer (relative to the casing 10) auxiliary apparatus according to the invention, associated with the tower section extending between the head ring 3 and the spacer ring 6. Each auxiliary apparatus has an upper and a lower traveling block 11 and 12, respectively. The traveling blocks 11 and 12 are guided on and supported by respective circular tracks 13 and 14 of I-section which, in turn, are attached to the underside of the head ring 3 and the top side of the spacer ring 6 and thus extend substantially parallel to one another. Between the flanges of the tracks 13, 14 there extend, on both sides of the vertical webs of the I-sections, runner wheels 15 supported on a frame 16 of each traveling block 11 and 12.

The frame 16 of the upper traveling block 11 and the frame 16 of the lower traveling block 12 are connected, at two corresponding frame ends, by linearly tensioned guide cables 17. It is noted that in FIGS. 1 and 2 only a single cable 17 is visible for each apparatus; the attachment of two cables 17 to the ends of the upper block frame 16 can be observed in FIG. 3. These components are so arranged that the guide cables 17 of both the outer and the inner auxiliary apparatus are disposed at a distance from the cable net 4, 9 and the casing 10.

Between the two tensioned guide cables 17 of each auxiliary apparatus there is guided a hoisting cage 18 for workmen. For this purpose, as it may be particularly well observed in FIGS. 4 and 5, there is provided, for each guide cable 17, a sleeve 23 which surrounds the associated guide cable 17 and which is articulated to a slide 20 movable in guide rails 19. The pivotal axis of the sleeve 23 is horizontal and is oriented perpendicularly to the guide cables 17. As it may be well observed in FIG. 3, the guide rails 19 are affixed to opposite longitudinal ends of the cage 18. Each slide 20 is guided by the associated guide rails 19 in such a manner that the cage 18 may be shifted with respect to a plane defined by the guide cables 17 towards and away from the casing 10 in a substantially horizontal direction. Such shifting movement, the purpose of which will become apparent later, can be effected by a cranking mechanism operating a screw-and-nut assembly. Thus, as shown in FIGS. 4, 5 and 6, a screw S is attached to the slide 20 and threaded through a nut M supported on the cage 18. A crank mechanism as illustrated in FIG. 6 rotates, when actuated by a workman in the cage 18, the nut M which, in turn, causes translational movement of the screw S and the slide 20, thus shifting the cage 18.

Figure 3:
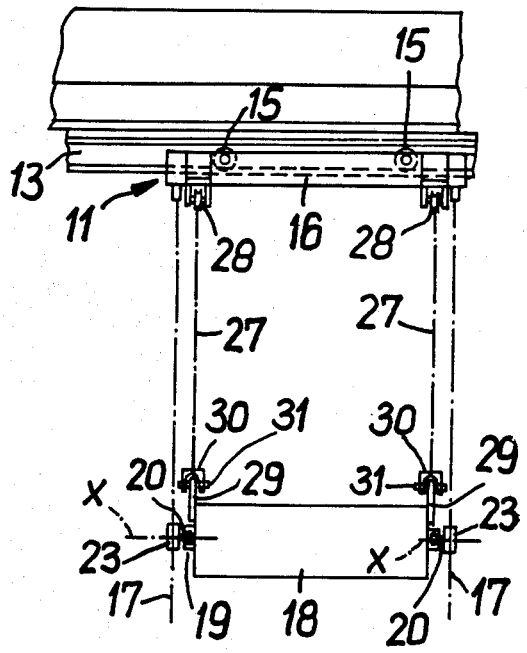
FIG. 3 is a side elevational view of a detail taken in the direction of arrow III of FIG. 2.

The frame 16 of the lower traveling block 12 carries two cable winches 26 (only one is visible in the figures). From the latter, hoist cables 27 extend upwardly to the deflecting rollers 28 which are supported at the underside of the frame 16 of the upper traveling block 11, in the vicinity of its longitudinal ends. From the deflecting rollers 28 the cables 27 extend downwardly to the eyes 29 which are affixed to the longitudinal ends of the hoisting cage 18 and are oriented upwardly. The cables 27, as seen in FIG. 3, are secured to the eyes 29 with yokes 30 and pivot pins 31, the axes of which extend horizontally and parallel to the length dimension of the frame 16 and the cage 18. Further, to the cage 18 there are secured rollers 32 by means of which the cage 18 can engage the casing 10 or the cable net 4, 9 of the cooling tower.

The hoisting cage 18 of each auxiliary apparatus is movable along the guide cables 17 by means of the winches 26 in the direction of the upper traveling block 11 or the lower traveling block 12. Since the radial distance of the guide cables 17 from the arcuate casing 10 and the cable net 4, 9 are different dependent upon height, the cages 18 are shifted with respect to the guide sleeves 23 in a radial, horizontal direction to such an extent that they always engage, with the rollers 32, the casing or the cable net framing, as the case may be. This is effected by shifting the slides 20 within the guide rails 19 relatively with respect to the cage 18 by the crank mechanism shown in FIG. 6 and described earlier. In this manner it is achieved that a worker in the hoisting cage 18 is brought as close as possible to that zone of the cable net in which the assembling work has to be performed. The articulated connection of the cage 18 with the guide sleeves 23 at the slides 20 makes possible that the cage 18 orients itself independently from the inclination of the guide cables 17 in such a manner that its bottom extends at least approximately horizontally.

In FIG. 2 there are shown in solid lines the hoisting cages 18 at the outer and inner side of the cooling tower wall. The upper terminal position and the lower position of each cage 18 at the inner side are illustrated in dash-dot lines. In the lower position the cage 18 is, when not in use, disposed on the frame 16 of the lower traveling block 12.

During operation care has to be taken to drive the upper traveling block 11 and the lower traveling block 12 in such a manner that they do not lead or lag substantially with respect to one another on the circular rails 13 and 14 respectively. In this manner it is ensured that the guide cables 17 remain in the vertical meridian planes to thus form with the frame 16 of the upper and the lower traveling block 11 and 12, respectively, a rectangle as it may be observed in FIG. 3. For this purpose, at least for the propelling mechanism of one of the two traveling blocks, there is provided a regulating device R which responds to a deviation of the position of the guide cables 17 from their above-described desired position. FIG. 1 illustrates, in the lower right hand field, that as a result of a lead of one of the two traveling blocks with respect to the other, the two guide cables 17 are disposed no longer in the meridian planes and, accordingly, they no longer form a rectangle with the frame 16 but, on the contrary, constitute an oblique parallelogram therewith. Upon appearance of an inclined angle $\alpha$ between one guide cable 17 and the vertical, determined for example, by a plumb line 33, the regulating device R is actuated in such a manner that it causes the drive mechanism A of the wheels W of the lower traveling block 12 to reestablish the initial, "rectangular" position of FIG. 3. If, for example, the angle $\alpha$ trails with respect to the vertical, the regulating device R will sense this lag and will cause a speed increase in the propelling mechanism A to drive the lower traveling block 12 faster than the speed of the upper traveling block 12 until $\alpha = 0$, indicating that the cables 17 again form a rectangle with the frame 16.

In case a breakage of one of the winch cables 27 occurs, the cage 18 would sink at that end, so that the bottom thereof would be oriented at an inclination to the horizontal. Such an occurrence, however, can take place only to a limited extent because of a clamping friction that appears between the guide cable 17 and the sleeve 23. In addition, the guide cables 17 prevent a harmful swinging of hoisting cage 18 in case of windy weather.

Further, in case both winch cables 27 break, there are provided safety measures to prevent a crash of the cage 18. For example, at the guide sleeves 23 there may be provided fall stopping devices which, when the cage begins to fall because of breakage of both hoisting cables 27, effect a clamping connection between the guide sleeves 23 and the guide cables 17. Fall stopping devices of this type are expediently based on the principle that as a result of a fall acceleration, inertia (centrifugal) brakes are actuated.

Figure 7:
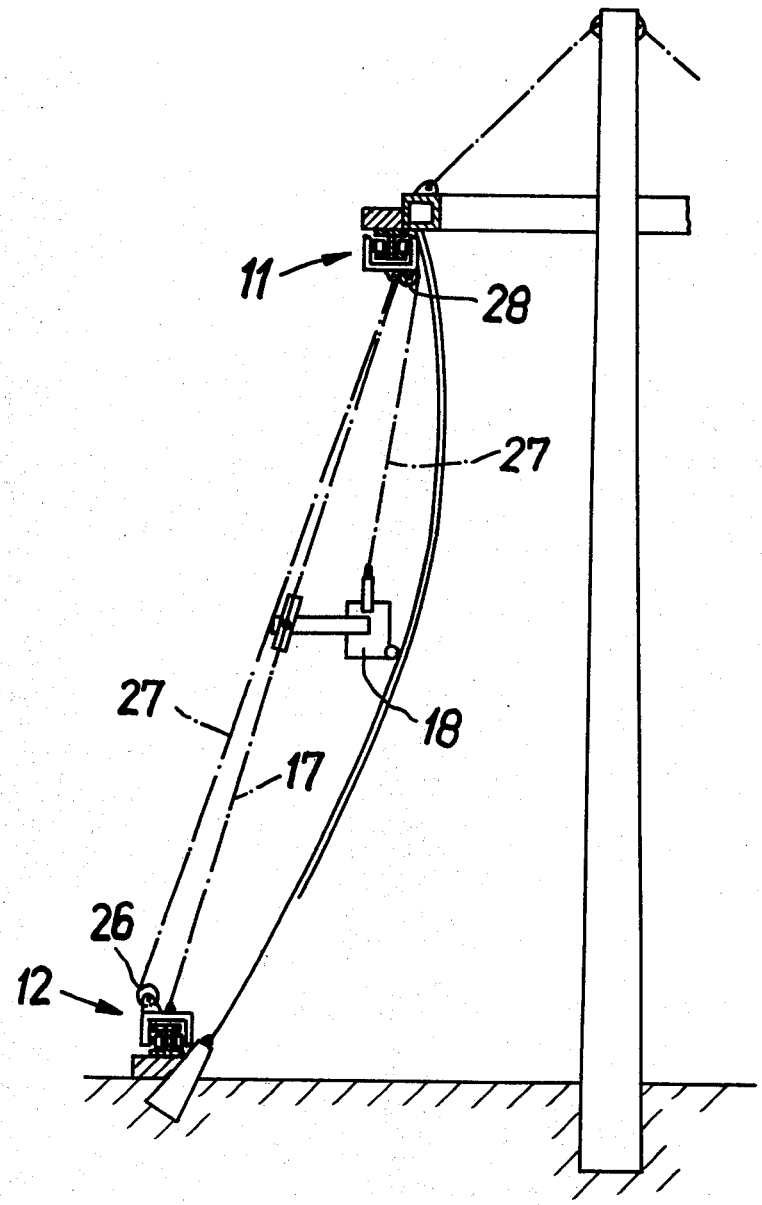
FIG. 7 is a schematic side elevational view, partly in section, of another preferred embodiment of the invention.

It is also feasible — as illustrated in FIG. 7 — to provide at the outside of the cooling tower wall a sole winch 26 for moving a cage along the entire height of the cooling tower. Such sole winch may travel on a circular track on the ground about the foundation members. Further, on one and the same arcuate track pair two or more pairs of upper and lower traveling blocks may be provided, each having a separate hoisting cage guided by guide cables 17.

Figure 8:
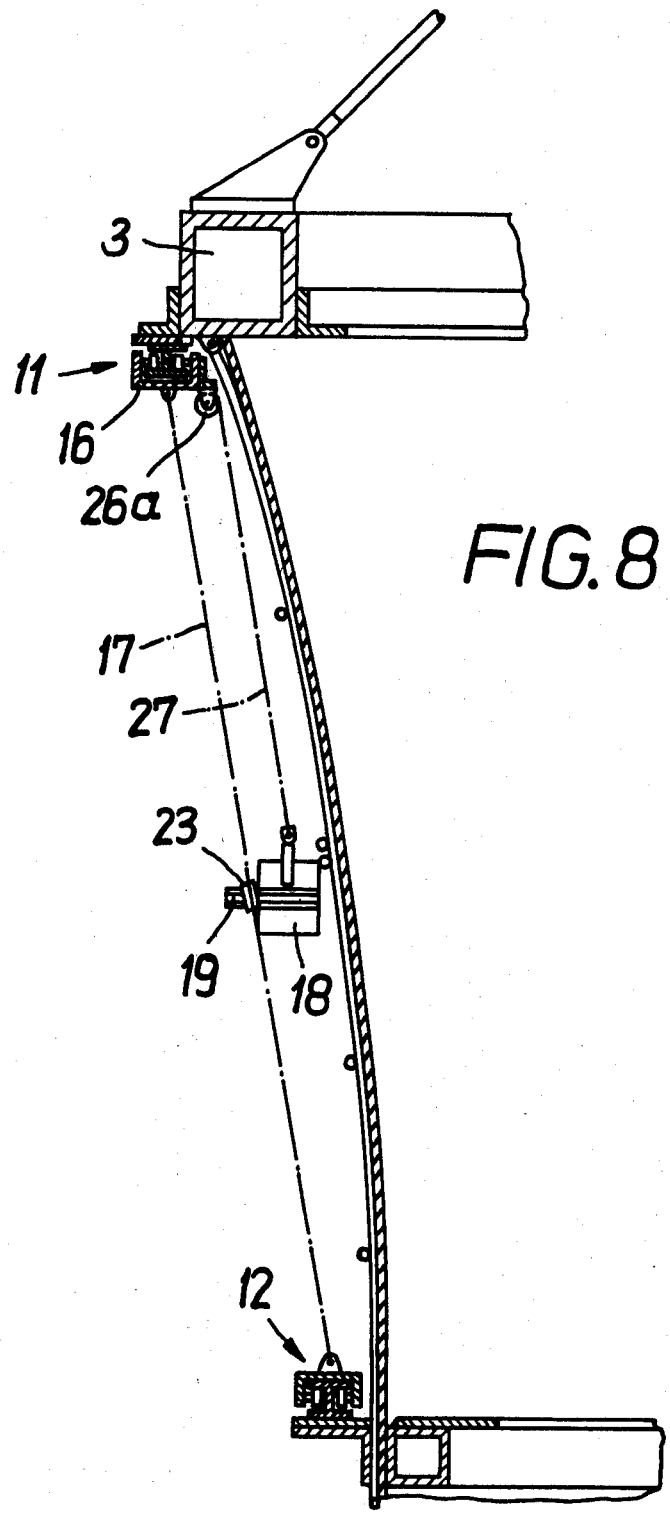
FIG. 8 is a schematic side elevational view, partly in section, of still another preferred embodiment of the invention.

Turning now to FIG. 8, it is further feasible to arrange winches **26*a* at the upper, rather than the lower, traveling block 11 for lifting and lowering the cages 18 along the guide cables 17. In such a case, the deflecting rollers 28 can be omitted and the lower traveling blocks 12 are needed only for anchoring the guide cables 17.**

It will be understood that the above description of the present invention is susceptible to various modifications, changes and adaptations, and the same are intended to be comprehended within the meaning and range of equivalents of the appended claims.

I claim:

1. A hoisting apparatus mounted on a cooling tower including a mast; a cable net framing supported by the mast; and a non-self-supporting casing attached to the framing; comprising in combination:

a. an upper and a lower track of circular, horizontal course; said tracks being vertically spaced from one another and extending along said casing substantially concentrically with respect to said mast;

b. an upper traveling block movably mounted on said upper track and a lower traveling block movably mounted on said lower track;

c. two horizontally spaced, parallel guide cables attached to and linearly tensioned between said upper and lower traveling blocks;

d. a hoisting cage situated between said upper and lower traveling blocks;

e. hoisting means secured to at least one of said traveling blocks and said hoisting cage for raising and lowering said hoisting cage between said traveling blocks;

f. an adjusting means connecting each guide cable to said hoisting cage for horizontally displacing said hoisting cage with respect to said guide cables in a direction substantially perpendicular to said casing;

g. a guide sleeve surrounding each said guide cable and being longitudinally slidable thereon;

h. coupling means pivotally attaching said adjusting means to the associated guide sleeve for providing for a pivotal movement of said adjusting means about a horizontal axis perpendicular to the two parallel guide cables; and i. propelling means for moving said upper and lower traveling blocks on and along the respective upper and lower tracks.

2. A hoisting apparatus as defined in claim 1, wherein said adjusting means includes separate elongated guide rails extending from the one and the other guide cable to said hoisting cage; a slide disposed in each guide rail for displacement in the direction of the length dimension of the guide rail; said coupling means articulating said slide to the associated said guide sleeve; a screw-and-nut assembly attached to said slide and said hoisting cage; and means for rotating the screw of the screw-and-nut assembly with respect to the nut of the screw-and-nut assembly for altering the distance of said hoisting cage from said guide cables.

3. An apparatus as defined in claim 1, further comprising compensating means for eliminating a lag of one of said traveling blocks with respect to the other during movement of said traveling blocks on said tracks.

4. An apparatus as defined in claim 1, including roller means supported on said cage and being in engagement with the building structure.

* * * * *